United States Patent [19]

Watkins

[11] 4,018,283

[45] Apr. 19, 1977

[54] METHOD AND APPARATUS FOR GRAVEL PACKING WELLS

[75] Inventor: Larry A. Watkins, Houston, Tex.

[73] Assignee: Exxon Production Research Company, Houston, Tex.

[22] Filed: Mar. 25, 1976

[21] Appl. No.: 670,303

[52] U.S. Cl. ..... 166/278; 166/233; 166/296

[51] Int. Cl.[2] ..... E21B 43/04; E21B 43/08

[58] Field of Search ..... 166/278, 276, 296, 284, 166/233, 231, 232, 229, 227, 157, 158, 205

[56] References Cited

UNITED STATES PATENTS

| | | | |
|---|---|---|---|
| 2,046,459 | 7/1936 | Johnson | 166/233 |
| 2,205,422 | 6/1940 | Layne | 166/278 |
| 3,216,497 | 11/1965 | Howard et al. | 166/296 X |
| 3,273,641 | 9/1966 | Bourne | 166/296 X |
| 3,322,199 | 5/1967 | Van Note, Jr. | 166/296 X |
| 3,385,373 | 5/1968 | Brown | 166/233 X |
| 3,450,207 | 6/1969 | Hirsch | 166/233 |
| 3,709,293 | 1/1973 | Layne et al. | 166/233 X |
| 3,880,233 | 4/1975 | Muecke et al. | 166/296 X |
| 3,958,634 | 5/1976 | Smith | 166/233 |

*Primary Examiner*—Stephen J. Novosad
*Attorney, Agent, or Firm*—Salvatore J. Casamassima

[57] ABSTRACT

The perforations of a tubular pipe are sealed with a selectively removable plugging material. The pipe is then wire wrapped to form a well screen. The annular passage defined by the pipe and wire wrapping is restricted enough so that the flow resistance in the annular passage is sufficient to maintain high fluid flow velocity outside the well screen during gravel packing so as to prevent the formation of gravel dunes. After gravel packing is completed, the plugging material is removed, permitting the passage of fluids through the well screen and pipe mandrel.

18 Claims, 2 Drawing Figures

METHOD AND APPARATUS FOR GRAVEL PACKING WELLS

BACKGROUND OF THE INVENTION

1. Field of the Invention

This invention relates to the completion of wells in subterranean formations. In one aspect it relates to an improved method and apparatus for gravel packing the annulus surrounding a wire wrapped liner placed in a well.

2. Description of the Prior Art

A major problem in completing wells in unconsolidated or loosely consolidated formations is sand control. Sand particles entrained in produced fluids can plug flow channels of the formation and can cause severe erosion of well equipment such as lines, the producing string, valves and pumps. A well known sand control technique is gravel packing, whereby properly sized gravel is placed opposite the unconsolidated formation, forming a sand exclusion zone which filters out the sand particles entrained in the produced fluid.

A conventional gravel packing technique involves locating a perforated liner at a subsurface location in the well and thereafter placing gravel around the liner. Normally, a slurry of gravel suspended in a liquid carrier is pumped into the annular space between the formation wall and the liner. As the suspension reaches the bottom of the annulus the gravel is deposited in the annulus on the exterior of the liner and the liquid carrier withdraws through the liner perforations and back up the casing string. In this manner, the gravel builds up until the entire annulus surrounding the liner is filled.

Ideally, the gravel should uniformly and compactly fill the wellbore annulus surrounding the liner. Unfortunately, in some wells, especially deviated wells, the gravel fails to pack uniformly, resulting in voids within the annulus which weaken the pack and permit the production of sand entrained fluids. For example, gravitational forces in deviated wells tend to cause some gravel to prematurely settle out near the upper end of the liner. As a result, a small gravel bank, referred to herein as a dune, begins to form within the upper end of the annulus. As the dune grows and descends down the annulus, more and more of the carrier liquid is diverted through the liner upstream of the dune thereby causing the velocity of the gravel suspension to decline. As velocity drops, the carrier liquid can no longer maintain the gravel in suspension with the result that additional gravel settles out until the dune completely blocks flow to the lower portions of the annulus. Substantially all of the carrier liquid is then diverted into the upstream section of the liner, causing the upper section of the annulus to pack while leaving a substantial void space in the lower section. In practice, a number of gravel dunes and void spaces may be formed in the manner described above.

In order to uniformly compactly fill the annulus surrounding a liner in an inclined wellbore, the upper flow channel must remain open until the lower section of the annulus is filled. One approach to improving gravel packing efficiency is the use of a wide diameter stinger as described in copending application, U.S. Ser. No. 661,662. A stinger is a tube, positioned through the liner, which serves as the return conduit for the carrier liquid. By selecting a wide diameter stinger the annular passage between the interior of the liner and the exterior of the stinger is very restricted. The decreased area available for fluid flow within the annular passage increases the resistance to flow in the passage and decreases the flow of carrier liquid into the liner. If the flow resistance is sufficient to maintain the minimum flow velocity of carrier fluid that is necessary to prevent or stabilize dune formation, then gravel packing efficiency will be greatly enhanced.

One problem with wide diameter stingers is that there may be very little clearance between the stinger and the inside of the liner. For example, clearances can be as little as one-eighth inch, creating the possibility of getting the stinger tightly lodged against the liner or stuck inside the liner. Only a slight dent or bend in the liner can cause this to happen.

SUMMARY OF THE INVENTION

The present invention relates to an improved wire wrapped wall screen design which results in uniform and compact gravel packing of a wellbore. In accordance with the invention, the perforations or slots of a tubular pipe are sealed with a selectively removable, temporary plugging material. Only the last few bottom rows of perforations are left unplugged. The pipe is then wire wrapped by well known techniques to form a wire wrapped well screen.

During gravel packing of a wellbore, a suspension of carrier liquid and gravel is flowed past the well screen. Carrier liquid, however, can only return to the surface by entering the unplugged slots or perforations of the pipe which are at the bottom of the well screen. Carrier liquid entering the well screen at any other point will be forced to flow in the annular passage defined by the plugged pipe and the wire wrapping.

The performance of the well screen critically depends on the size of the annular passage. The annular passage must be sufficiently restrictive so that the resistance to flow in the annular passage forces most of the carrier liquid to flow in the wellbore along the exterior of the well screen. In this manner, the velocity of the carrier liquid is maintained at or above the minimum flow velocity necessary to prevent the premature settling of the gravel particles. That is, the flow velocity must be sufficient to prevent or arrest dune formation. On the other hand, the annular passage cannot be so restrictive that an unacceptably high pressure drop arises during gravel packing.

Proper sizing of the annular passage can be calculated by selecting a flow resistance in the annular passage which will result in efficient gravel packing yet will not be unacceptably high. A flow resistance above about 0.12 psi/ft for slightly deviated wells and 0.24 psi/ft for highly deviated wells will normally yield a good gravel pack. (For the purposes of the present invention, a wellbore incline of greater than 45° is a highly deviated well.) Using a modified version of the Fanning equation the proper spacing between the pipe and wire wrapping can be computed. The pipe and wire wrap can be spaced apart by standoff ribs or grooves machined into the pipe. A useful approximation is to select standoff ribs having a diameter of about 0.25 inches for a pipe O.D. of about 2 inches and about 0.15 inches for a pipe O.D. of about 7 inches. Rib diameters from 0.15 inches to 0.25 inches can be interpolated for pipe diameters between 2 and 7 inches.

Once the gravel is placed and the carrier liquid withdrawn, the plugging material is removed, permitting free flow of produced fluids. Depending on the type of plugging material selected, removal of the plugging material can be achieved by solvent extraction, chemical decomposition or melting.

DESCRIPTION OF THE PREFERRED EMBODIMENT

Figure 1:
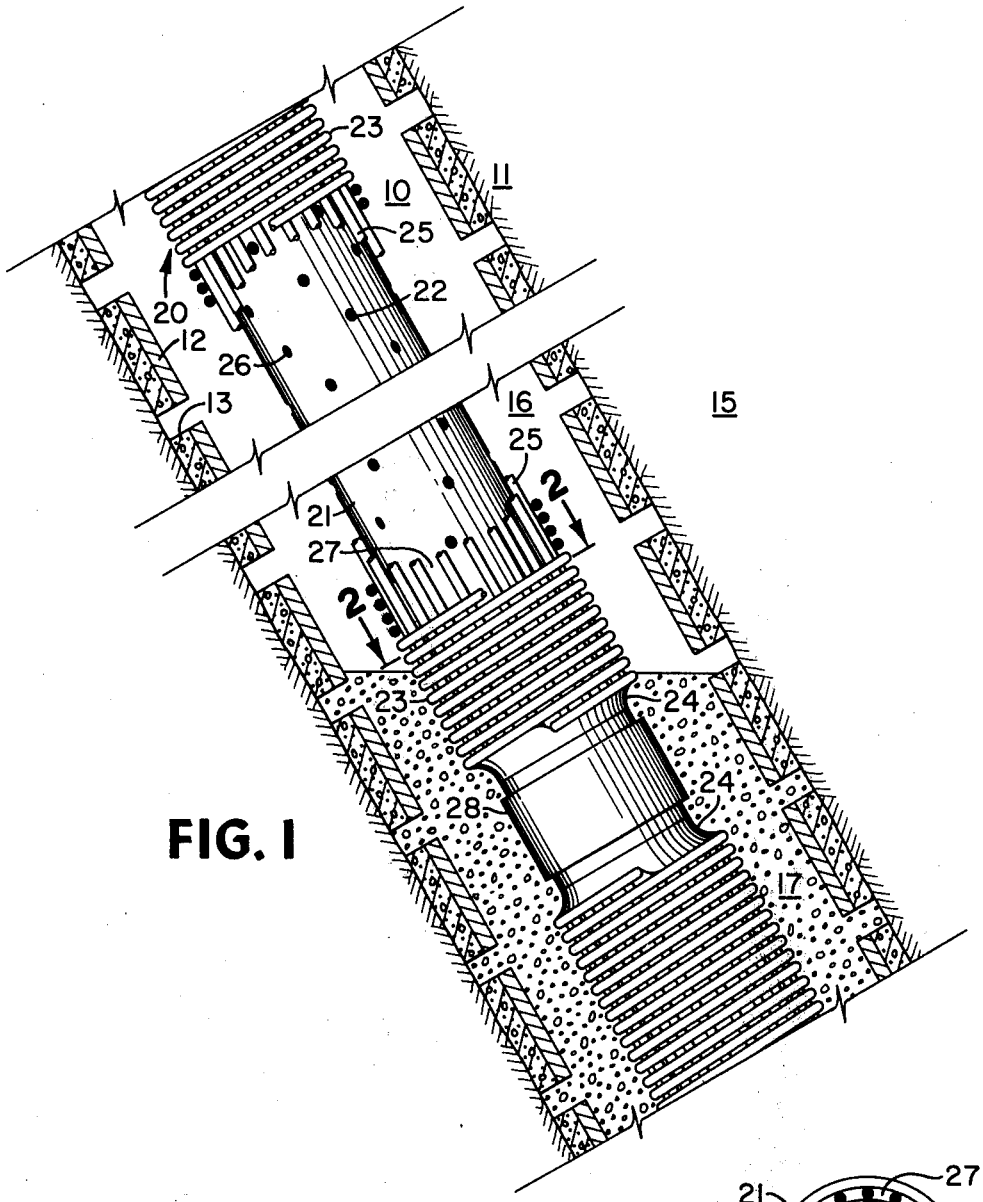
FIG. 1 is a schematic of the wire wrapped screen of this invention after it has been lowered into a wellbore and used to partially gravel pack the wellbore.

With reference to FIG. 1, an inclined wellbore 10 penetrates a subterranean producing formation 11. Well casing 12 which extends through the well and is held in place by cement 13 is provided with perforations 14 in the producing zone 15 to be gravel packed.

Wire wrapped well screen 20 is placed in wellbore 10 opposite producing zone 15. Annular space 16, which is defined by well screen 20 and casing 12, is the area to be packed with gravel. The term "gravel" as used herein refers to any granular or aggregate material used for filtering purposes in subsurface wells.

Well screen 20 includes a perforated pipe 21 which has a wire wrapping 23 mounted thereon. The wire wrapping 23 can be secured on pipe 21 by annular end weld beads 24, as illustrated, or by end retainer rings. Sections of well screen 20, usually 28 to 32 feet in length, can be threadably connected by joint coupling 28 to form a well screen of desired length. For purposes of the present discussion, the terms "perforated pipe", "tubular pipe" or "pipe", as used herein, refer to a wide range of perforated subsurface devices used in wells. They are referred to in the art as "preperforated liners", "vertically slotted liners", "horizontally slotted liners" and the like.

Figure 2:
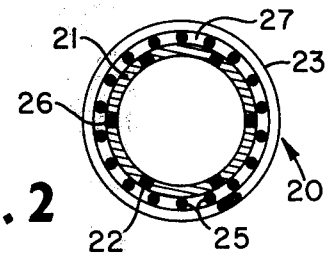
FIG. 2 is a cross-sectional view along plane 2—2 of FIG. 1.

Considering FIGS. 1 and 2, tubular pipe 21 has a plurality of perforations 22 which can be holes, as illustrated, or slots. In the present invention, perforations 22 are plugged or sealed with a plugging material 26 which can be selectively removed after gravel packing has been completed. A preferred plugging material is paraffin wax. Only the very last two or three rows of perforations (not shown) of the entire well screen apparatus are left unplugged. It is through these perforations that the gravel carrier liquid will be forced to enter in order to return to the surface.

Wire wrapping 23 is coiled around pipe 21 in a helical fashion and is spaced apart from pipe 21 by standoff ribs 25. Standoff ribs 25 are usually made of steel wire which is welded at each point of intersection with wire wrapping 23. The interstices between the wire wraps are spaced so as to permit the entrance of fluids while preventing the entrance of sand, fines and other solids, thereby serving the purpose of a filtering screen.

The gravel may be deposited using a conventional inside gravel packing technique. However, it should be noted that this method applies equally well to open hole gravel packs. Well screen 20 is lowered into wellbore 10 on the well tubing string (not shown) which normally includes a well crossover tool (not shown). Gravel and a carrier liquid, normally water, are mixed to form a gravel suspension which is then pumped through the tubing, crossing over to the outside of well screen 20. Gravel 17 is deposited within annular space 16. Carrier liquid entering well screen 20 through wrapping 23 will, however, be prevented from penetrating pipe 21 because perforations 22 are plugged. The carrier liquid is, therefore, forced to either travel through annular passage 27 defined by the pipe 21 and wire wrapping 23 or in annular space 16 within the wellbore. No carrier liquid can enter pipe 21 until it traverses the entire length of the well screen 20 whereupon it can enter the unplugged perforations at the bottom of the screen. Carrier liquid can then flow up the pipe 21 and return to the surface.

The present invention eliminates the need for a stinger or other type of return tube because pipe 21 operates as the return conduit. More importantly, the carrier liquid is completely diverted from entering pipe 21 except at the bottom of the screen. Consequently, a higher velocity of carrier liquid can be maintained in annular space 16. If the carrier liquid velocity is sufficiently high, then the gravel particles will remain in suspension and will not prematurely settle out near the upper portions of the well screen. Dune formation will therefore be prevented entirely or arrested in its early stages, resulting in high gravel packing efficiency.

The amount of spacing between wire wrapping 23 and pipe 21 as determined by the size of standoff ribs 25 is very important. If the spacing is too great then annular passage 27 will permit the entry of too much carrier liquid from the flow channel defined by annular space 16. Carrier liquid velocity will drop and dune formation is likely to occur. If, on the other hand, there is insufficient spacing between the mandrel and the wire wrapping an unacceptably high pressure drop may result. Hence, an upper limit on the size of annular passage 27 is determined by the maintenance of the minimum flow velocity of carrier liquid necessary to prevent dune formation. The lower limit can be established by setting a maximum allowable pressure drop which can be tolerated.

The method for computing the upper limit on the size of annular passage 27 is a modification of techniques described in copending application U.S. Ser. No. 661,662 for computing the optimum stinger diameter for a liner. For example, one technique involves calculating the resistance to flow in the annulus between the stinger and liner. A high flow resistance in the annulus between the liner and the stinger prevents carrier liquid from readily entering the liner, thereby maintaining a sufficiently high carrier liquid velocity to prevent or arrest dune formation. Generally, the flow resistance inside the annulus formed by the stinger and liner should be about 0.12 psi/ft or higher for slightly deviated wells and 0.24 psi/ft or higher for highly deviated wells. (For purposes of the present invention, a highly deviated well is a well having an incline angle greater than 45°). These flow resistances will normally result in high packing efficiency. By substituting the desired flow resistance in the Fanning equation for flow in an annulus the proper stinger diameter can be calculated. (See Perry's Chemical Engineer's Handbook, Fifth Edition, p. 520)

In the present invention, the stinger is eliminated. However, an annulus defined by a stinger and the inside of a liner and annular passage 27 shown in FIG. 1 between the plugged pipe 21 and the wire wrapping 23 are analogous. Both annuli serve as flow conduits for any carrier liquid which leaves the wellbore and enters the gravel packing tool. Thus, for example, a flow resistance of about 0.24 psi/ft or higher in annular passage 27 will yield a good approximation for the upper limit on the size of the passage if the tool is used in highly deviated wells. The computational change necessary is the correction of the Fanning equation for the flow area of annular passage 27 blocked off by standoff ribs 25. In this calculation the outside diameter of the pipe (corresponding to stinger diameter) is known. The unknown is the diameter of the standoff ribs 25 which will provide the proper spacing for annular passage 27 necessary to prevent dune formation. The diameter of the standoff rib computed by the above method, if based on a flow resistance of 0.24 psi/ft, will be the maximum diameter which can be used without sacrificing gravel packing efficiency.

The smallest diameter standoff rib which can be used is determined by setting a maximum allowable pressure drop which can be tolerated. For example, as gravel placement proceeds, the lower portion of the annular space 16 fills with gravel and most of the flow of carrier liquid occurs in the well screen down annular passage 27. The total pressure drop is the pressure drop in annular passage 27 (as computed by the modified Fanning Equation) plus the pressure drop attributable to flow through short lengths of gravel bed 17 occurring when carrier liquid must flow past joint coupling 28 to get from one section of well screen 20 to the next section.

EXAMPLE

Recommended standoff rib diameter for use in gravel packing well screens of the present invention were calculated using a selected pressure drop of 1.0 psi/ft in the annular passage between the pipe and the well screen. This was considered a sufficient flow resistance to achieve high packing efficiency without creating an unacceptable pressure drop during gravel packing operations. Given the flow resistance of 1.0 psi/ft, the standoff rib diameters corresponding to various pipe outside diameters were calculated using the modified Fanning equation for flow in an annulus. Water, having a viscosity of 1 centipoise and a flow rate of 1 barrel per minute, was selected as the carrier liquid. Table I summarizes the calculations.

TABLE I

| Pipe Diameter (O.D. - inches) | Standoff Ribs | |
|---|---|---|
| | Number | Diameter (inches) |
| 2.375 | 15 | .2087 |
| 2.875 | 17 | .1958 |
| 3.500 | 21 | .1898 |
| 5.000 | 27 | .1721 |

Table I indicates useful approximations for rib diameters for a range of pipe sizes. Conventional well screens have standoff ribs with a diameter of about 0.10 inches. In contrast, the above Table, if extrapolated somewhat, shows that the standoff ribs of the present invention should have diameters ranging from about 0.15 inches for large diameter well screens (having a pipe O.D. of about 7 inches) to about 0.25 inches for small diameter well screens (having a pipe O.D. of about 2 inches).

More sophisticated design correlations can be developed with the aid of regression analysis. For example, the critical velocity of the carrier liquid necessary to stabilize dune formation can be determined in a series of experiments in which other parameters are varied. The critical velocity can then be mathematically correlated with a dimensionless function of the varied parameters. Once such a correlation is established the critical velocity can be determined for a given gravel packing system. Knowing the critical velocity, the pressure drop in the flow channel above the stabilized dune bank can be calculated. This pressure drop will be equal to the pressure drop in the annulus between the pipe and the well screen and represents the resistance to flow in the annulus. By substituting the pressure drop in the Fanning equation, the stinger diameter can then be determined.

Note that this correlation technique permits the computation of the smallest flow resistance in the pipe-well screen annulus which is necessary to stabilize dune formation. Thus the Fanning equation, using that flow resistance, will yield the minimum standoff rib diameter needed to achieve efficient packing. This technique offers a more precise way of determining proper standoff rib diameter than the previously described method in which a flow resistance above 0.24 psi/ft for high deviated wells or 0.12 psi/ft for less deviated wells is somewhat arbitrarily selected.

Other embodiments of well screen design are possible. For example, the standoff ribs used in many well screens are shaped to have triangular rather than circular cross sections. The only change necessary in the computational calculations of the present invention is the modification of the Fanning equation to account for the geometric configuration of the standoff rib.

Other types of well screens employ grooved pipes. Standoff ribs are not used in such screens. Instead, the spacing between the wire screen and the pipe is achieved by alternate ridges and grooves machined into the outside surface of the pipe. The principle of the present invention, however, is unchanged. Once again, it is only necessary to modify the Fanning equation so as to adapt it to the geometric design of the pipe-screen annulus. The dimensions of the grooves of the ridges in the pipe can then be calculated using a selected pressure drop for the annulus.

As shown in FIG. 1 and in the cross sectional view of the well screen 20 of FIG. 2, pipe perforations 22 are plugged with plugging material 26 which can be selectively removed once gravel placement is completed, thereby opening the pipe perforations. Produced fluids can then flow freely from producing zone 15, through gravel 17, into well screen 20, and back up to the surface.

A preferred plugging material is paraffin wax. Paraffin wax is inexpensive and can be readily inserted into the pipe perforations or slots prior to wrapping the pipe with wire. Furthermore, a large variety of waxes with a wide range of melting points are available. Thus a wax plugging material can be selected with a melting temperature slightly below the temperature of the formation. Once the gravel is in place and all carrier liquid is removed, the wellbore temperature will begin to approach that of the formation causing the wax to melt, thus opening up the pipe perforations. The melting point of the wax must be below the temperature of the formation but above that of the gravel suspension. Ideally, the wax selected should have a melting point about 10° F lower than the formation temperature.

Other plugging materials may also be employed. Thermoplastic resins which have comparatively high melting points can be used when high formation temperatures are encountered. However, if a relatively low formation temperature is encountered, then a low melting alloy, such as Woods' alloy, might be suitable. The plugging material need not be a heat-sensitive material.

In another embodiment of the invention, the plugs can be removed by solvent extraction or acidic decomposition. For example, if wax or polystyrene plugs are used, solvents such as acetone, toluene or xylene can be pumped into the well to dissolve the plug once the gravel packing phase is completed. Alternatively, if aluminum plugs are used then a caustic solution of NaOH can be employed to selectively corrode the aluminum.

The present invention can be used to improve gravel packing efficiency in vertical wells. However, its main value will be in the prevention or minimization of dune formation in highly deviated wells. When used in deviated wells, gravel packing efficiency can be greatly improved.

The principle of the invention and various modifications and embodiments have been described. It should be realized that the foregoing is illustrative only and that other means and techniques can be employed without departing from the scope of the claimed invention.

I claim:

1. In a method of gravel packing a well screen opposite a subterranean formation in a well wherein a carrier liquid having gravel suspended therein is flowed downwardly along the outside of said well screen and upwardly through the bottom of said well screen, said well screen including a tubular pipe having perforations formed therein which is concentrically wrapped with a wire screen, the improvement comprising:

sealing the perforations of said pipe with a temporary plugging material;

adjusting the radial clearance between said pipe and said wire screen so that the resistance to flow in the annular shaped passage defined by the exterior of said pipe and the interior of said wire screen is sufficient to maintain at least the minimum flow velocity of said carrier liquid along the outside of said well screen necessary to prevent premature settling of said gravel and the formation of gravel dunes near the upper portions of said well screen; and selectively removing said plugging material after said gravel is in place.

2. The method as recited in claim 1 wherein the radial clearance between said pipe and said wire screen is adjusted by inserting a plurality of longitudinally spaced wire standoff ribs between said pipe and said wire screen, said standoff ribs having a diameter of between about 0.15 inches and 0.25 inches.

3. The method as recited in claim 1 wherein the radial clearance between said pipe and said wire screen is adjusted by machining a plurality of longitudinally spaced grooves into the outer surface of said pipe.

4. The method as recited in claim 1 wherein the resistance to flow in said annular shaped passage is at least about 0.12 pounds per square inch per foot of length of said well screen if said well is vertical or slightly deviated and at least 0.24 pounds per square inch per foot of length of said well screen if said well is highly deviated.

5. The method as recited in claim 1 wherein said plugging material is a fusible, heat sensitive material with a melting point below the normal temperature of said well where said well screen is positioned and wherein said plugging material is removed by melting said plugging material with heat generated by said well.

6. The method as recited in claim 5 wherein said fusible material is wax.

7. The method as recited in claim 5 wherein said fusible material is a thermoplastic resin.

8. The method as recited in claim 5 wherein said fusible material is a low melting point alloy.

9. The method as recited in claim 1 wherein said plugging material is a dissolvable material and wherein said plugging material is removed by extracting said plugging material with a solvent.

10. The method as recited in claim 1 wherein said plugging material is a decomposable material and wherein said plugging material is removed by decomposing said plugging material with a corrosive chemical.

11. A well screen for packing gravel wells comprising:

a tubular pipe having perforations formed therein;

a selectively removable plugging material sealing the perforations of said pipe;

a wire screen extending circumferentially around said pipe; and a plurality of standoff wire ribs longitudinally spaced along said pipe, said wire ribs providing a clearance of between about 0.15 inches and 0.25 inches between said pipe mandrel and said wire screen such that the resistance to flow in the annular passages defined by the exterior of said pipe, the interior of said wire screen and the wire ribs is sufficient to maintain at least the minimum velocity of a carrier liquid, having gravel suspended therein, necessary to prevent premature settling of said gravel and the formation of gravel dunes near the upper portions of said well screen during gravel packing.

12. The well screen as defined in claim 11 wherein the resistance to flow in said annular shaped passage is at least about 0.12 pounds per square inch per foot of length of said well screen if said well is vertical or slightly deviated and at least 0.24 pounds per square inch per foot of length of said well screen if said well is highly deviated.

13. The well screen as defined in claim 11 wherein said plugging material is a fusible, heat sensitive material with a melting point below the normal temperature of said well where said well screen positioned and wherein said plugging material is removed by melting said plugging material with heat generated by said well.

14. The well screen as defined in claim 13 wherein said fusible material is wax.

15. The well screen as defined in claim 13 wherein said fusible material is a thermoplastic resin.

16. The well screen as defined in claim 13 wherein said fusible material is a low melting point alloy.

17. The well screen as defined in claim 11 wherein said plugging material is a dissolvable material and said plugging material is removed by extracting said sealant with a solvent.

18. The well screen as defined in claim 11 wherein said plugging material is a decomposable material and wherein said plugging material is removed by decomposing said plugging material with a corrosive chemical.

* * * * *